US006045275A

United States Patent [19]

Hosoya

[11] Patent Number: 6,045,275

[45] Date of Patent: Apr. 4, 2000

[54] THERMAL HEAD CONTROLLER

[75] Inventor: Hayato Hosoya, Fukushima-ken, Japan

[73] Assignee: Alps Electric Co., Ltd., Tokyo, Japan

[21] Appl. No.: 09/118,687

[22] Filed: Jul. 17, 1998

[30] Foreign Application Priority Data

Jul. 18, 1997 [JP] Japan ..... 9-194648
Jul. 23, 1997 [JP] Japan ..... 9-197581

[51] Int. Cl.[7] ..... B41J 2/315
[52] U.S. Cl. ..... 400/120.01
[58] Field of Search ..... 400/120.01; 324/678; 346/76

[56] References Cited

U.S. PATENT DOCUMENTS

| | | | |
|---|---|---|---|
| 4,870,428 | 9/1989 | Kuwabara et al. | 346/76 |
| 4,893,951 | 1/1990 | Iwatani et al. | 400/225 |
| 4,955,736 | 9/1990 | Iwata et al. | 400/120 |
| 5,300,960 | 4/1994 | Pham et al. | 346/154 |
| 5,339,099 | 8/1994 | Nureki et al. | 346/76 |
| 5,852,369 | 12/1998 | Katsuma | 324/678 |
| 5,874,982 | 2/1999 | Ueda et al. | 347/194 |

FOREIGN PATENT DOCUMENTS 6-155698 6/1994 Japan .

*Primary Examiner*—Edgar Burr
*Assistant Examiner*—Charles H. Nolan, Jr.
*Attorney, Agent, or Firm*—Brinks Hofer Gilson & Lione

[57] ABSTRACT

A thermal head controller includes a central processing unit (CPU), a storage unit, an arithmetic unit, a controller, and a thermal head. The CPU reads print data stored in the storage unit. The storage unit holds print data to be printed on a stamp print face, which are transferred from a host computer. The CPU transfers the read data to the arithmetic unit, and causes the arithmetic unit to perform print-pattern processing. The arithmetic unit stores pattern data in its shift register before processing the stored pattern data. The print-pattern processing is performed so as to prevent fine print from being erased due to the deformation of the stamp print face caused by heat conduction in polyethylene foam sheet when the stamp print face is formed. The CPU uses the controller to control the thermal energy of dots positioned on the border between print dots and non-print dots on the thermal head.

7 Claims, 8 Drawing Sheets

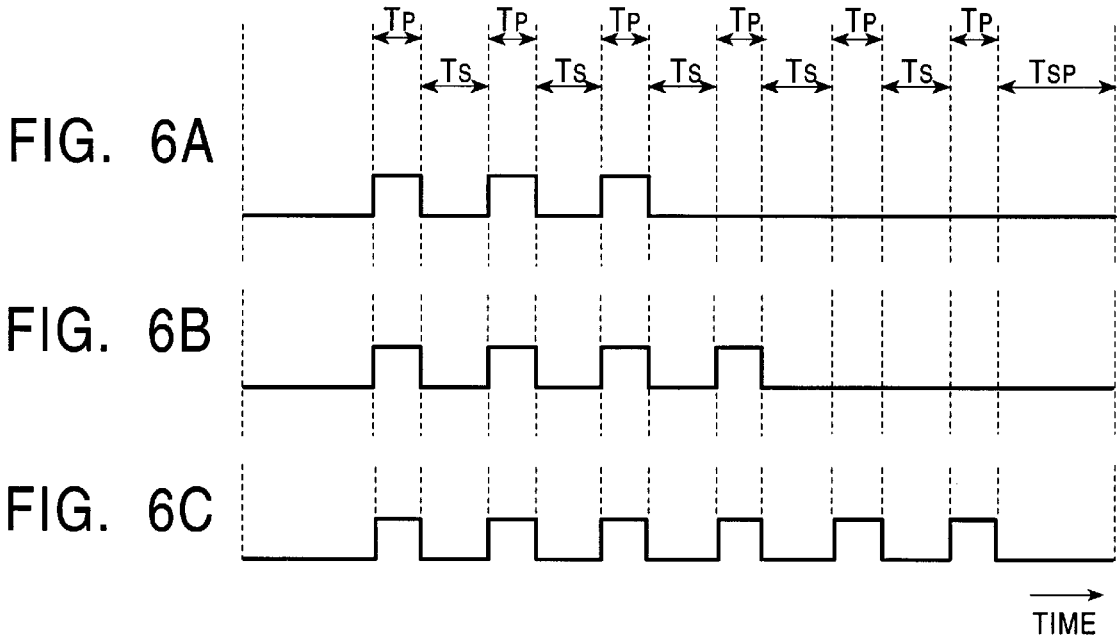
FIG. 7
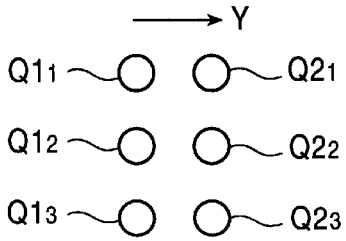

THERMAL HEAD CONTROLLER

BACKGROUND OF THE INVENTION

1. Field of the Invention

The present invention relates to a thermal head controller for controlling a thermal head that easily forms an arbitrary-image print face on a roller stamp material.

2. Description of the Related Art

In Japanese Unexamined Patent Application No. 3-96383, there have been disclosed as conventional methods for producing a print face made of sponge rubber having continuous bubbles, the following techniques for selectively clogging continuous pores:

(1) Performing the screen printing of a clogging adhesive;

(2) Spraying a clogging adhesive on a masked area before removing the mask;

(3) Bonding a thermosensitive pourous film to cause clogging before using a thermal head or flash heat to make pores;

(4) Using a thermal head or flash heat to transfer a trans-thermo film to cause clogging;

(5) Using a thermal head to directly heat and melt a surface to cause clogging; and (6) Emitting light onto photocurable resin to cause clogging, whereby forming the stamp print face of a plane stamp.

In Japanese Unexamined Patent Application No. 6-155698, there has been disclosed a technique in which heat waves are selectively emitted to a polyolefin foam sheet surface having continuous bubbles to form the stamp print face of a plane stamp.

In Japanese Unexamined Patent Application No. 7-251558, there has been disclosed a method for producing the stamp print face of a plane stamp by compressing an elastic resin sheet in which stamp ink having continuous bubbles can be impregnated between a thermal head and a platen.

In fact, concerning the above-described methods, the advent of a polyethylene foam sheet made by Yamahachi Chemicals Co., Ltd. has realized a remarkable impregnated stamp that has never existed.

In the above-described formation of a stamp print face with a thermal head, a polyethylene foam sheet is deformed by its heat conduction. For example, in the case where the print pattern shown in FIG. 2A is printed on the polyethylene foam sheet by using the dots of the thermal head, it is ideal to obtain a stamp print face having the section shown in FIG. 2B. In FIGS. 2A and 2B, black circles indicate a print-dot pattern, and white circles indicate a non-print dot pattern.

However, an actually obtained stamp print face has the section shown in FIG. 9B. The section is formed by a phenomenon in which thermal energy from the dots of the thermal head diffuses to deform the non-print dots in region R1 shown in FIG. 9A.

As a result, in the section of the print face shown in FIG. 9B, although region R2 must be included in non-print area S, it is deformed due to the heat diffusion in the polyethylene foam sheet to form print area Q.

Accordingly, the polyethylene foam sheet has a disadvantage in which contraction due to the above-described deformation causes bubble clogging beyond a necessary range for the stamp print face. This causes a problem in which fine printed lines on the stamp print face are erased. When the thermal head uses the thermal energy from heating resistors to perform continuous printing, the thermal energy is accumulated to increase the temperature. In addition, in the heating resistors is left heating energy generated just before the continuous printing.

Therefore, non-print dots surrounded by pint dots are deformed by the above-described factors, and are clogged by bubbles in the polyethylene foam sheet. As a result, according to the above-described, conventional thermal head controller, the non-print dots around the print dots disadvantageously have a condition similar to the case where the printing by the thermal head is performed.

In other words, when the pattern shown in FIG. 5A is used to perform printing, the section of a print face on a polyethylene foam sheet taken on dotted line A–A' is formed such that the section of non-print dots R1, shown in FIG. 5B, becomes the section of region R1. The thermal head performs printing on the polyethylene foam sheet in the order of pattern data P1 to P7. Black circles indicate print dots, and while circles indicate non-print dots.

Pattern data P1 consists of a set of dot data $\{P1_1, P1_2, P1_3, P1_4, P1_5\}$. Similarly, pattern data $P2=\{P2_1, P2_2, P2_3, P2_4, P2_5\}$ pattern data $P3=\{P3_1, P3_2, P3_3, P3_4, P3_5\}$ pattern data $P4=\{P4_1, P4_2, P4_3, P4_4, P4_5\}$ pattern data $P5=\{P5_1, P5_2, P5_3, P5_4, P5_5\}$ pattern data $P6=\{P6_1, P6_2, P6_3, P6_4, P6_5\}$ pattern data $P7=\{P7_1, P7_2, P7_3, P7_4, P7_5\}$ Region R1 shown in FIG. 5B is formed based on dot data $P6_3$ corresponding to a non-print dot. In the pattern data, dot data $P6_3$ is adjacent to dot data $P5_2$, $P5_3$, $P5_4$, $P6_2$, $P6_4$, $P7_2$, $P7_3$ and $P7_4$. Accordingly, region R1 corresponding to dot data $P6_3$ is deformed to have the shape of region R2, due to heating energy accumulated in the thermal head, heating energy left in the heating resistors, and the diffusion of thermal energy in the polyethylene foam sheet.

Similarly, as described above, the polyethylene foam sheet has a defect in which contraction caused by the deformation generates bubble clogging beyond a necessary range for the stamp print face. This causes a problem in which fine lines on the stamp print face are erased.

SUMMARY OF THE INVENTION

The present invention has been made under the above-described background. Accordingly, it is an object of the present invention to provide a thermal head controller that produces a stamp print face in which no bubble clogging occurs beyond a necessary range for the stamp print face and on which fine lines cannot be erased.

To this end, according to a first aspect of the present invention, the foregoing object has been achieved through provision of a thermal head controller for controlling heating energy generated from heating resistors provided in a thermal head by using pattern data composed of dot data as print-dot data representing print dots and non-print-dot data representing non-print dots so that the thermal head performs predetermined printing, the thermal head controller comprising: storage means for holding the pattern data; comparing means for comparing dot data in the pattern data and other data adjacent to the dot data and outputting the compared result; data conversion means for converting the print-dot data, which are obtained when the compared result shows that print dots and non-print dots are adjacently positioned, into adjacent-dot data representing that the print dots are adjacent to the non-print dots; and energy control means for controlling the heating energy generated from the heating resistors in the thermal head by using the print-dot data, the non-print-dot data and the adjacent-dot data.

According to another aspect of the present invention, the foregoing object has been achieved through provision of a thermal head controller for controlling heating energy generated from heating resistors provided in a thermal head by using pattern data composed of a plurality of dot data as print-dot data representing print dots and non-print-dot data representing non-print dots so that the thermal head performs predetermined printing, the thermal head controller comprising: first storage means for holding the pattern data; measuring means for measuring the temperature of the thermal head and outputting resultant temperature data; detection means for detecting whether adjacent dot data in the pattern data are either print-dot data or non-print-dot data and outputting a resultant detection signal; arithmetic means for computing a power value to be supplied to the heating resistors, based on at least the temperature data and the detection signal; and energy control means for controlling heating energy generated from the heating resistors, based on the power value.

According to a further aspect of the present invention, the foregoing object has been achieved through provision of a thermal head controller for controlling heating energy generated from heating resistors provided in a thermal head by using pattern data composed of dot data as print-dot data representing print dots and non-print-dot data representing non-print dots so that the thermal head performs predetermined printing, the thermal head controller comprising: first storage means for holding the pattern data; measuring means for measuring the temperature of the thermal head and outputting resultant temperature data; detection means for detecting whether adjacent dot data in the pattern data are either print-dot data or non-print-dot data and outputting a resultant detection signal; second storage means for holding a power value corresponding to at least the temperature data and the detection signal; reading means for reading from the second storage means the power value, based on the temperature data and the detection signal; and energy control means for controlling the heating energy from the heating resistors, based on the read power value.

BRIEF DESCRIPTION OF THE DRAWINGS

FIGS. 6A, 6B and 6C are waveform charts illustrating print-pattern data processing according to a second embodiment of the present invention.

FIG. 7 is a schematic view showing a dot arrangement, which illustrates the operation of a second embodiment of the present invention.

DESCRIPTION OF THE PREFERRED EMBODIMENTS

Figure 1:
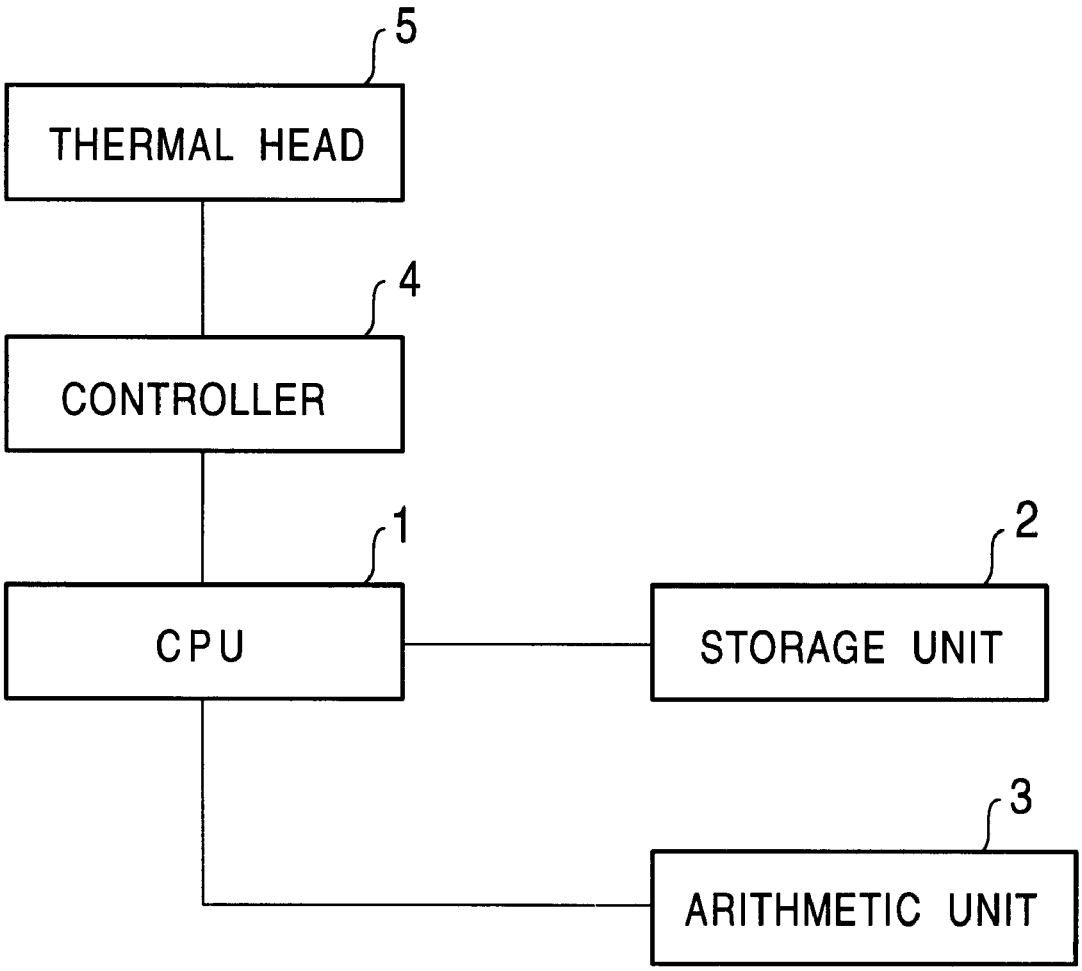
FIG. 1 is a block diagram showing a thermal head according to a first embodiment of the present invention.

A first embodiment of the present invention will be described below, with reference to FIGS. 1, 2A, 2B, 2C, 3A, and 3B. FIG. 1 shows a block diagram of a thermal head controller according to the first embodiment of the present invention. A central processing unit (CPU) 1 reads print data stored in a storage unit 2. The storage unit 2 holds printing data to be printed on a stamp print face, which are transferred from a host computer (not shown).

The CPU 1 transfers the read data to an arithmetic unit 3, and causes the arithmetic unit 3 to perform print-pattern processing. The arithmetic unit 3 reads pattern data shown in FIG. 2A, and processes the read pattern data. The pattern data consists of seven dot data, such as $P1=\{P1_1, P1_2, P1_3, P1_4, P1_5, P1_6, P1_7\}$. The arithmetic unit 3 includes a shift register (not shown) capable of holding three sets of pattern data.

The pattern-data processing prevents fine print from being erased due to deformation of the stamp print face, caused by the thermal conduction of a polyethylene foam sheet when the print face is formed. In other words, the CPU 1 uses a controller 4 to control the thermal energy from print dots positioned on the border between print dots and non-print dots in a thermal head 5.

The controller 4 uses power supplying to control the exothermic energy of each dot in the thermal head 5 in accordance with a print pattern sent from the CPU 1. The controller 4 has three levels of power to be supplied to the thermal head 5. The three levels of power have the following relationship:

power level A>power level B>power level C

The power level A is supplied to print dots around which there are print dots. The power level B is supplied to print dots on the border between the print dots and the non-print dots in the thermal head 5. The power level C (normally zero) is supplied to the non-print dots in the thermal head 5.

Next, an example of the operation of the first embodiment will be described with reference to FIG. 1, 2A and 2B, and 3A and 3B.

Figure 2A:
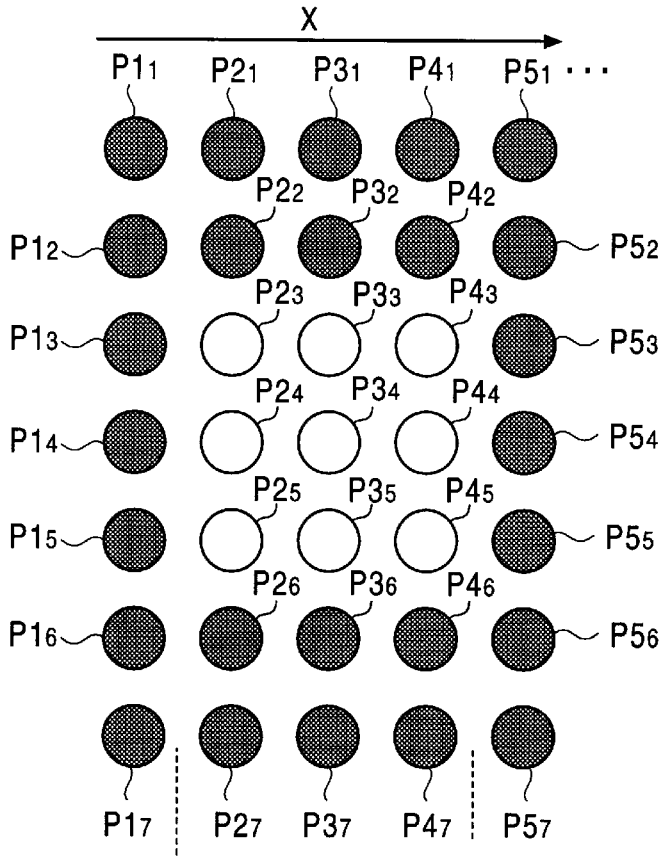
FIGS. 2A, 2B and 2C are pattern views showing print-pattern data on a thermal head, which illustrate the operation of a first embodiment of the present invention.
Figure 2B:
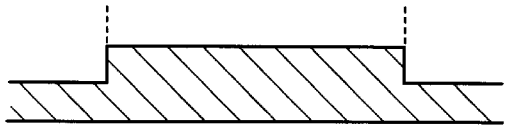

For example, the dot pattern as a print pattern, shown in FIG. 2A, is transferred to the thermal head 5 to form a print face having the section shown in FIG. 2B.

Initially, the CPU 1 reads data having the print pattern shown in FIG. 2A from the storage unit 2.

The CPU 1 reads data pattern P1 ($=\{P1_1, P1_2, P1_3, P1_4, P1_5, P1_6, P1_7,\}$ where $P1_1$ to $P1_7$ are dot data), data pattern P2 ($=\{P2_1, P2_2, P2_3, P2_4, P2_5, P2_6, P2_7\}$ where $P2_1$ to $P2_7$ are dot data), data pattern P3 ($=\{P3_1, P3_2, P3_3, P3_4, P3_5, P3_6, P3_7\}$ where $P3_1$ to $P3_7$ are dot data, data pattern P4 ($=\{P4_1, P4_2, P4_3, P4_4, P4_5, P4_6, P4_7\}$ where $P4_1$ to $P4_7$ are dot data), and data pattern P5 ($=\{P5_1, P5_2, P5_3, P5_4, P5_5, P5_6, P5_7\}$ where $P5_1$, to $P5_7$) in the order given, and transfers them to the arithmetic unit 3.

The CPU 1 reads the pattern data P1 to P3 shown in FIG. 2A from the storage unit 2, and writes them in a shift register included in the arithmetic unit 3. The arithmetic unit 3 holds the pattern data P1 to P3, in which each data represented by a black circle is "01 (binary number)" and each data represented by a white circle is "00 (binary number)" (where the right data bit is a least significant bit). Accordingly, the dot data have the positional relationship shown in FIG. 2C.

Among pattern data P2, print-pattern processing for dot data $P2_2$ will be described. Dot data $P2_2$ is stored data "01 (binary number)" and print data. In accordance with this stored data, the arithmetic unit 3 detects whether or not dot data $P2_2$ is positioned on the border between print data and non-print data.

Figure 2C:
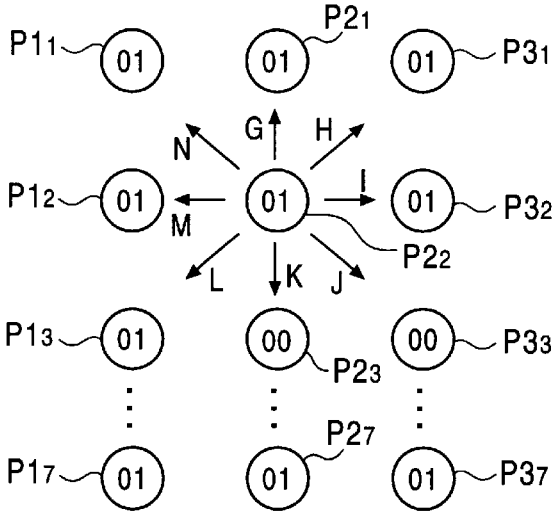

In other words, the arithmetic unit 3 compares dot data $P2_2$ with the dot data in the arrow directions G, H, I, J, K, L, M and N shown in FIG. 2C. The arithmetic unit 3 initially computes the AND of dot data $P2_2$ with its least significant bit. The obtained AND is "1", which indicates that dot data $P2_2$ is "01".

The arithmetic unit 3 computes, for example, the AND operation of dot data $P2_2$ with the least significant bit of dot data $P2_1$ in the direction of arrow G. The obtained AND is "1", which confirms that dot data $P2_2$ is not adjacent to non-print data in the direction of arrow G.

The arithmetic unit 3 computes the AND operation of dot data $P2_2$ with the least significant bit of dot data $P3_1$ in the direction of arrow H. The obtained AND is "1", which confirms that dot data $P2_2$ is not adjacent to non-print data in the direction of arrow H.

The arithmetic unit 3 computes the AND of dot data $P2_2$ with the least significant bit of dot data $P3_2$ in the direction of arrow I. The obtained AND is "1", which confirms that dot data $P2_2$ is not adjacent to non-print data in the direction of arrow I.

The arithmetic unit 3 computes the AND of dot data $P2_2$ with the least significant bit of dot data $P3_3$ in the direction of arrow J. The obtained AND is "0", which confirms that dot data $P2_2$ is adjacent to non-print data in the direction of arrow J.

The arithmetic unit 3 computes the AND of dot data $P2_2$ with the least significant bit of dot data $P2_3$ in the direction of arrow K. The obtained AND is "0", which confirms that dot data $P2_2$ is adjacent to non-print data in the direction of arrow K.

The arithmetic unit 3 computes the AND of dot data $P2_2$ with the least significant bit of dot data $P1_3$ in the direction of arrow L. The obtained AND is "1", which confirms that dot data $P2_2$ is not adjacent to non-print data in the direction of arrow L.

The arithmetic unit 3 computes the AND of dot data $P2_2$ with the least significant bit of dot data $P1_2$ in the direction of arrow M. The obtained AND is "1", which confirms that dot data $P2_2$ is not adjacent to non-print data in the direction of arrow M.

The arithmetic unit 3 computes the AND of dot data $P2_2$ with the least significant bit of dot data $P1_1$, in the direction of arrow N. The obtained AND is "1", which confirms that dot data $P2_2$ is not adjacent to non-print data in the direction of arrow N.

Description concerning dot data $P2_2$ has been done. The arithmetic unit 3 performs AND operation with adjacent dots nine times, including the AND operation of above-described, predetermined dot data itself, as to all the dot data of pattern data P2.

In the case where it is confirmed that predetermined data is print data and is adjacent to non-print-dot data in even one direction, the arithmetic unit 3 changes dot data $P2_2$, for example, from "01 (binary number)" to "11 (binary number)". The upper bit (left bit) represents a dot that is supplied with power value B.

As described above, after the comparison between two adjacent dot data ends, the CPU 1 reads from the shift register in the arithmetic unit 3 the pattern data, e.g., pattern data P1 before transferring them to the controller 4. The CPU 1 simultaneously reads from the storage unit 2 the next pattern data whose print-pattern processing is performed, for example, pattern data P4 ({$P4_1$, $P4_2$, $P4_3$, $P4_4$, $P4_5$, $P4_6$, $P4_7$}), and writes them in the shift register in the arithmetic unit 3.

Figure 3A:
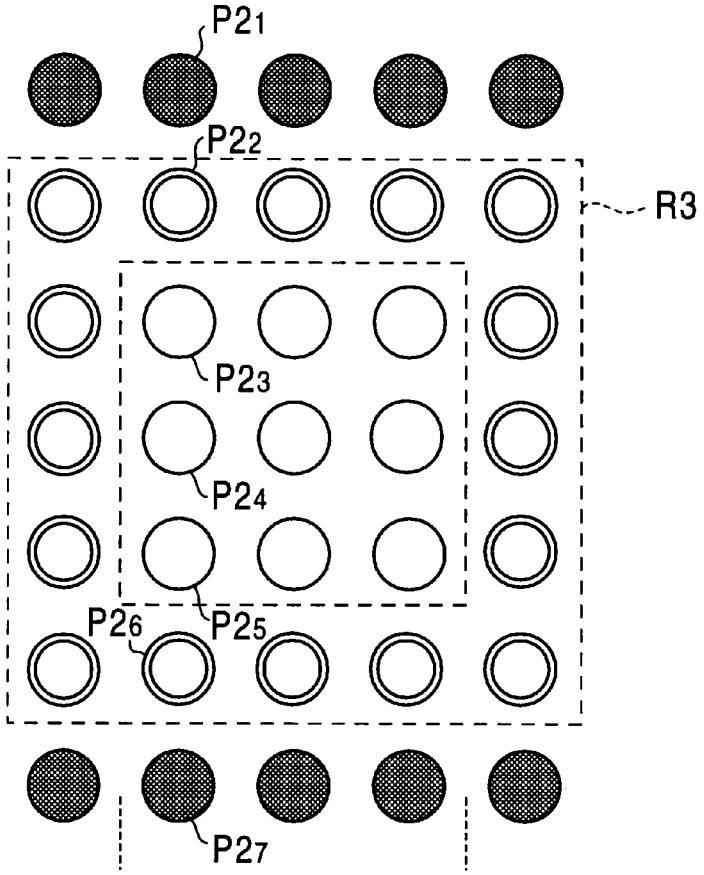
FIGS. 3A and 3B are pattern views illustrating print-pattern data processing according to a first embodiment of the present invention.

The print-pattern data shown in FIG. 2A are converted into the print-pattern data shown in FIG. 3A by print-pattern processing by the arithmetic unit 3. In other words, the double-circle dots in region R3 indicate print-dot data "11" around white-circle non-print dot data, and represent that the dots are supplied with power level B.

As a result, the CPU 1 time-serially transfers the print-pattern data shown in FIG. 3A from the arithmetic unit 3 to the controller 5 in the order of termination of print-pattern processing in the arithmetic unit 3.

In addition, even in the case where dot data are converted into "11" for printing on the border between print-dot data and non-print-dot data, there is no problem in comparison with adjacent dot data in the arithmetic unit 3.

In other words, the arithmetic unit 3 performs the AND operation of the least significant bits of adjacent dot data. Accordingly, for example, the AND operation of dot data $P2_2$ and $P3_2$ is the AND operation of dot data "11" and "01" since the dot data value of dot data $P2_2$ is "11" as a result of print-pattern processing. As a result, the result of the AND operation is "1", and it is found that no problem occurs in the AND operation of adjacent print-dot data.

In accordance with dot data in the input pattern data, the controller 1 controls the heating energy from the heating resistors of the thermal head 5, corresponding to the dot data. For example, when pattern data P2 are input, the dot data of pattern data P2 are as follows: $P2_1$="01", $P2_2$="11", $P2_3$="00", $P2_4$="00", $P2_5$="00", $P2_6$="11", and $P2_7$="01", so that the controller 4 supplies the corresponding power levels to the corresponding dots of the thermal head 5.

When dot data is "00", the controller 4 supplies power level C to the corresponding heating resistor of the thermal head 5. When dot data is "11", the controller 4 supplies power level B to the corresponding heating resistor of the thermal head 5. When dot data is "01", the controller 4 supplies power level A to the corresponding heating resistor of the thermal head 5.

Figure 3B:
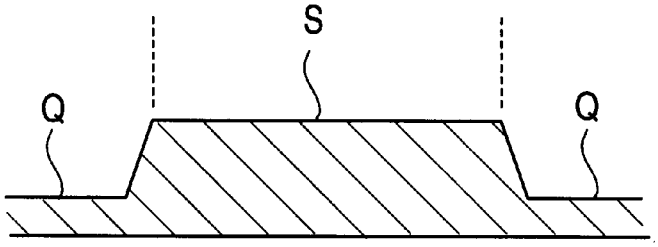

As a result, concerning the print face on the polyethylene foam sheet, which is printed with the print-pattern data shown in FIG. 2A, non-print area S and print area Q formed by the thermal head 5, shown in FIG. 3B, correspond to the print-pattern data shown in FIG. 2A.

The comparison between adjacent dot data by using AND operation has been described. However, other comparison techniques may be used.

As described above, a thermal head controller according to the first embodiment causes print dots positioned on the border between print dots and non-print dots to have heating energy lower than that from print dots not adjacent to the non-print dots, whereby enabling print processing for preventing the deformation of a non-print dot region on the border between the print dots and non-print dots. In addition, according to the thermal head controller according to the first embodiment, non-print dots are not worn to enable fine printing.

Figure 4:
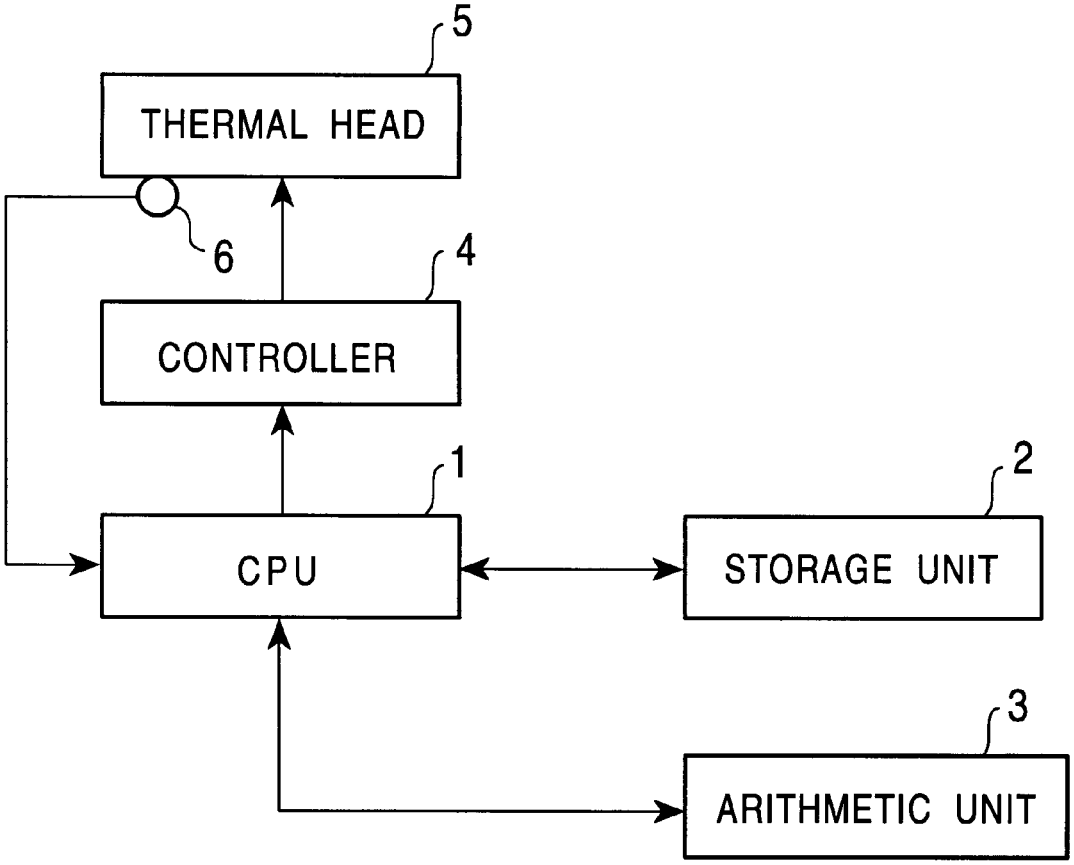
FIG. 4 is a block diagram showing a thermal head controller according to a second of the present invention.

Next, a second embodiment of the present invention will be described with reference to FIGS. 4, 5A, 5B, 5C, 6A, 6B, 6C, and 7. FIG. 4 shows a block diagram of a thermal head controller according to the second embodiment of the present invention. A CPU 1 reads print data stored in a storage unit 2. The storage unit 2 holds print data to be printed on a stamp print face, which are transferred from a host computer (not shown).

The CPU 1 transfers the read print data to an arithmetic unit 3, and causes the arithmetic unit 3 to perform print-pattern processing. The arithmetic unit 3 reads the pattern data shown in FIG. 5A, and processes the read pattern data.

The pattern data consist of six dot data, such as P1={$P1_1$, $P1_2$, $P1_3$, $P1_4$, $P1_5$, $P1_6$}. The arithmetic unit 3 includes a register (not shown) capable of holding the previous pattern data. The pattern-data processing prevents fine print from being erased due to deformation of the stamp print face, caused by the thermal conduction of a polyethylene foam sheet when the print face is formed. The CPU 1 controls the arithmetic unit 3 to compute the heating energy of heating resistors in a thermal head 5 from a condition in which adjacent dots are printed or not printed, and the temperature of the thermal head 5.

In accordance with the print pattern sent from the CPU 1 and the heating energy computed by the arithmetic unit 3, a controller 4 controls the heating energy of each dot in the thermal head 5 by using power supplying to the heating resistors. The controller 4 also uses a plurality of levels of power to control the heating resistors in the thermal head 5. For example, the plurality of levels of power are realized by setting the width and number of constant-width pulses to predetermined values.

The arithmetic unit 3 changes the number of pulses to be supplied to the heating resistors in accordance with a condition in which adjacent dots are printed or not printed. For description, pulses supplied to dot data Q22 shown in FIG. 7 will be mentioned. It is assumed that dot data Q22 be print data. The direction in which printing by the thermal head 5 is performed is the direction of arrow Y.

In the case where data corresponding to at least dots Q12, Q21 and Q23 adjacent to dot Q22 are print-dot data, the number of pulses for printing dot Q22 to be sent from the controller 4 to the heating resistors is set to, for example, three by the arithmetic unit 3, as shown in FIG. 6A.

In the case where data corresponding to adjacent dot Q12 is print-dot data, the number of pulses for printing dot Q22 to be sent from the controller 4 to the heating resistors is set to, for example, four by the arithmetic unit 3, as shown in FIG. 6B.

In the case where data corresponding to the adjacent dots are not print data, the number of pulses for printing dot Q22 to be sent from the controller 4 to the heating resistors is set to, for example, six by the arithmetic unit 3, as shown in FIG. 6C.

In addition, the CPU 1 uses a temperature sensor 6 to measure the temperature $T_S$ of the thermal head 5. Based on the measured temperature data, the CPU 1 computes the width $T_P$ of pulses (shown in FIGS. 6A to 6C) to be supplied from the arithmetic unit 3 to the heating resistors. In FIGS. 6A to 6C, the interval of pulses is represented by $T_S$, and an interval at which pattern data are printed is represented by $T_{SP}$.

The relationship between the pulse width $T_P$ and the temperature $T_S$ of the thermal head 5 is as follows:

When $0° C. \leqq T_S < 10° C.$ (condition a), $T_P = 1.2$ msec

When $10° C. \leqq T_S < 50° C.$ (condition b), $T_P = 0.6$ msec

When $50° C. \leqq T_S$(condition c), $T_P = 0.3$ msec

Next, an example of the operation of one embodiment of the present invention will be described with reference to FIGS. 4, and 5A, 5B and 5C.

A print face is formed by printing an image on a polyethylene foam sheet. For example, a process in which the dot-pattern (print-pattern) data shown in FIG. 5A are transferred to the thermal head 5 to form a print face having the section shown in FIG. 5C will be described.

Figure 5A:
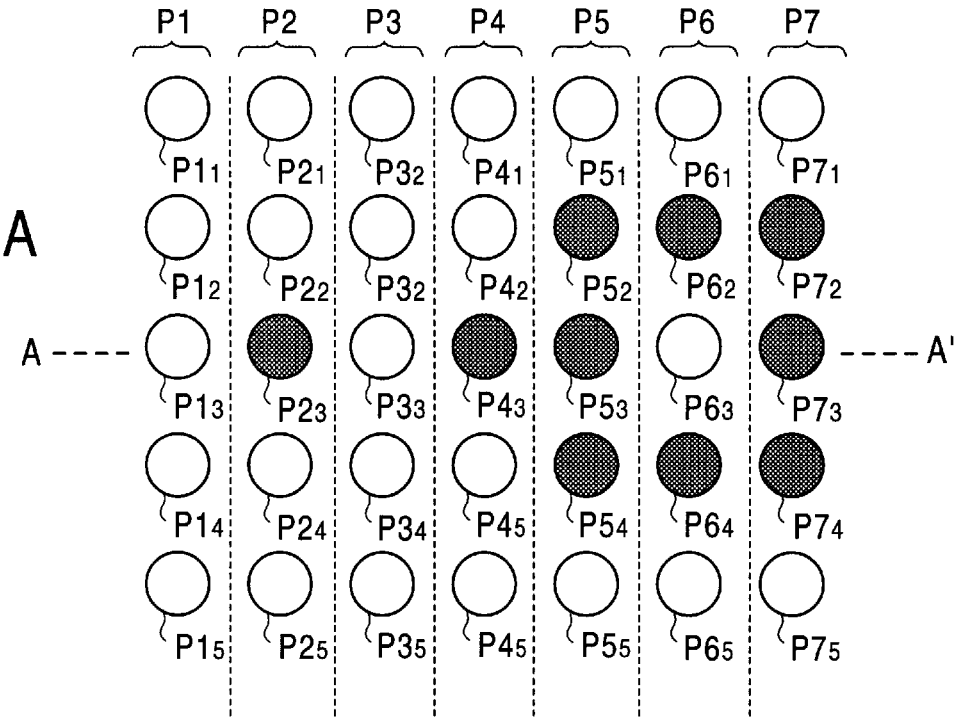
FIGS. 5A, 5B and 5C are pattern views showing print-pattern data on a thermal head, which illustrate the operation of a second embodiment of the present invention.
Figure 5B:
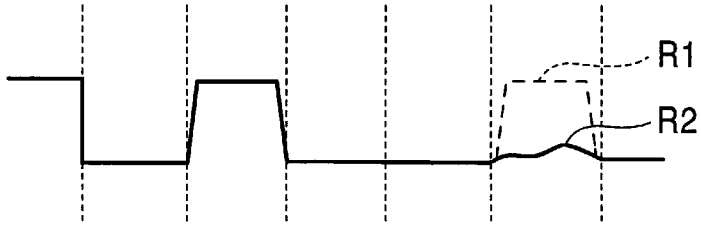
Figure 5C:
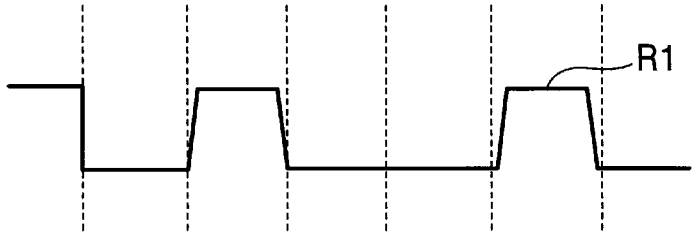

The CPU 1 time-serially reads print-pattern data shown in FIG. 5A from the storage unit 2.

The CPU 1 reads data pattern P1 (={$P1_1$, $P1_2$, $P1_3$, $P1_4$, $P1_5$} where $P1_1$ to $P1_5$ are dot data), data pattern P2 (={$P2_1$, $P2_2$, $P2_3$, $P2_4$, $P2_5$} where $P2_1$ to $P2_5$ are dot data), data pattern P3 (={$P3_1$, $P3_2$, $P3_3$, $P3_4$, $P3_5$} where $P3_1$ to $P3_5$ are dot data), data pattern P4 (={$P4_1$, $P4_2$, $P4_3$, $P4_4$, $P4_5$} where $P4_1$ to $P4_5$ are dot data), data pattern P5 (={$P5_1$, $P5_2$, $P5_3$, $P5_4$, $P5_5$} where $P5_1$ to $P5_5$ are dot data), data pattern P6 (={$P6_1$, $P6_2$, $P6_3$, $P6_4$, $P6_5$} where $P6_1$ to $P6_5$ are dot data) and data pattern P7 (={$P7_1$, $P7_2$, $P7_3$, $P7_4$, $P7_4$} where $P7_1$ to $P7_5$ are dot data) in the order given, and sequentially transfers them to the arithmetic unit 3.

The CPU 1 initially reads from the storage unit 2, the pattern data P1 (shown in FIG. 5A) to be printed by the thermal head 5. The CPU 1 transfers the read pattern data P1 to the arithmetic unit 3. In the arithmetic unit 3, the input pattern data P1 are written in its internal shift register.

The arithmetic unit 3 holds the pattern data P1, in which each print data represented by a black circle is "1 (binary number)" and each non-print data represented by a white circle data is "0 (binary number)".

The arithmetic unit 3 performs print-pattern processing for each dot data in pattern data P1. Since no pattern data are stored before pattern data P1, the arithmetic unit 3 sets the number of pulses to be supplied to the heating resistors to "six". The CPU 1 finds the temperature $T_S$ of the thermal head 5 to be "5° C." as a result of measurement since printing by the thermal head 5 is not performed. This causes the arithmetic unit 3 to set the pulse width $T_P$ to be supplied to the heating resistors at "1.2 msec".

The CPU 1 reads from the storage unit 2, pattern data P2 (shown in FIG. 5A) to be secondly printed by the thermal head 5. The CPU 1 transfers the read pattern data P2 to the arithmetic unit 3. In the arithmetic unit 3, the input pattern data P2 are written in its internal shift register.

As a result, the shift register in the arithmetic unit 3 holds pattern data P1 and P2.

The arithmetic unit 3 performs print-pattern processing for pattern data P2. The CPU 1 reads from the arithmetic unit 3, the pattern data P1 and control data on the dots of pattern data P1, and simultaneously reads pattern data P3 from the storage unit 2.

The CPU 1 transfers to the controller 4, the read pattern data, and the control data, which are composed of number-of-pulses data and pulse-width data to be supplied to the dots of pattern data P1. The controller 4 supplies to the heating resistors of the thermal head 5, "six" pulses having a pulse width $T_P$ of "1.2 msec". The CPU 1 transfers the read pattern data P3 to the arithmetic unit 3. The arithmetic unit 3 writes the input pattern data P3 in its register.

As described above, the CPU 1 sequentially transfers to the arithmetic unit 3, the pattern data P1 and P3 read from the storage unit 2. The arithmetic unit 3 performs print-pattern processing, based on the comparison between the two input pattern dots.

The CPU 1 sequentially reads pattern data from the arithmetic unit 3, and transfers them to the controller 4. As a result, the controller 4 controls the printing operation of the thermal head 5, based on the pattern data and its control data input from the CPU 1.

Next, the print-pattern processing performed in the arithmetic unit 3 will be described, paying attention to pattern data P5 and P6.

While the thermal head 5 is print pattern data P3, the arithmetic unit 3 holds the dots {$P4_1$, $P4_2$, $P4_3$, $P4_4$, $P4_5$} of pattern data P4 and the dots {$P5_1$, $P5_2$, $P5_3$, $P5_4$, $P5_5$} of pattern data P5 in its shift register.

The temperature of the thermal head 5, detected by the temperature sensor 6 at this time, is found to be "20° C." by the CPU 1. As a result, based on a detection signal from the CPU 1, the arithmetic unit 3 determines that the temperature condition of the thermal head 5 is "condition b", and set pulse width $T_P$, which is supplied to the heating resistors, at "0.6 msec".

The arithmetic unit 3 detects whether two adjacent dots are print-dot data or non-print-dot data in the dots {$P4_1$, $P4_2$, $P4_3$, $P4_4$, $P4_5$} of the pattern data P4 and the dots {$P5_1$, $P5_2$, $P5_3$, $P5_4$, $P_5$} of the pattern data P5.

In the pattern data P5, dot $P5_1$ is non-print-dot data. As a result, the arithmetic unit 3 confirms no need for supplying power for generating heating energy to the heating resistor corresponding to dot $P5_1$. The arithmetic unit 3 sets the number of pulses to be supplied at "zero".

Dot $P5_2$ in pattern data P5 is print-dot data. AND operation by the arithmetic unit 3 confirms that adjacent dot $P4_2$, which is printed just before dot $P5_2$, is non-print-dot data. Similarly, it is confirmed that adjacent dot $P5_1$, which is simultaneously printed, is non-print-dot data.

Likewise, it is confirmed that adjacent dot $P5_3$, which is simultaneously printed, is print-dot data. As a result, the arithmetic unit 3 sets the number of pulses, which are supplied to the heating resistor corresponding to dot $P5_2$, at "six", as shown in FIG. 6C.

Next, dot $P5_3$ in pattern data P5 is print data. AND operation by the arithmetic unit 3 confirms that adjacent dot $P5_3$, which is printed before dot $P5_2$, is print-dot data. Similarly, it is confirmed that adjacent dot $P5_2$, which is simultaneously printed, is print-dot data.

Likewise, it is confirmed that adjacent dot $P5_4$, which is simultaneously printed, is print-dot data. As a result, the arithmetic unit 3 sets the number of pulses, which are supplied to the heating resistor corresponding to dot $P5_3$, at "three", as shown in FIG. 6C.

Next, dot $P5_4$ in pattern data P5 is print-dot data. AND operation by the arithmetic unit 3 confirms that adjacent dot $P4_4$, which is printed before dot $P5_4$, is non-print-dot data. Similarly, it is confirmed that adjacent dot $P5_3$, which is simultaneously printed, is print-dot data.

Likewise, it is confirmed that adjacent dot $P5_5$, which is simultaneously printed, is non-print-dot data. As a result, the arithmetic unit 3 sets the number of pulses, which are supplied to the heating resistor corresponding to dot $P5_4$, at "three", as shown in FIG. 6C.

Next, dot $P5_5$ in pattern data P5 is non-print-dot data. As a result, the arithmetic unit 3 confirms no need for supplying power for generating heating energy to the heating resistor corresponding to dot $P5_5$ The arithmetic unit 3 sets the number of pulses at "zero".

After the thermal head 5, controlled by the controller 4, finishes printing pattern data P3, the CPU 1 reads pattern data P4 and control data on the dots of pattern data P4 from the arithmetic unit 3, and outputs them to the controller 4. The outputs cause the controller 4 to use the thermal head 5 to start print pattern data P4.

At the same time, the CPU 1 reads pattern data P6 from the storage unit 2, and writes them in the shift register in the arithmetic unit 3. The writing causes the arithmetic unit 3 to perform print processing based on adjacent data on each dot, as to the dots of pattern data P5 and the dots of pattern data P6 stored in the shift register.

While the thermal head 5 is print pattern data P4, the arithmetic unit 3 holds the dots {$P5_1$, $P5_2$, $P5_3$, $P5_4$, $P5_5$} of pattern data P5 and the dots {$P6_1$, $P6_2$, $P6_3$, $P6_4$, $P6_5$} of pattern data P6 in its shift register.

At this time, the temperature of the thermal head 5, detected by the temperature sensor 6, is found to be "60° C." by the CPU 1. As a result, based on a detection signal from the CPU 1, the arithmetic unit 3 determines that the temperature condition of the thermal head 5 is "condition c". The arithmetic unit 3 sets pulse width $T_P$, which is supplied to the heating resistor, at "0.3 msec".

The arithmetic unit 3 detects whether two adjacent dots are print-dot data or non-print-dot data in the dots {$P5_1$, $P5_2$, $P5_3$, $P5_4$, $P5_5$} in the dots of pattern data P5 and the dots {$P6_1$, $P6_2$, $P6_3$, $P6_4$, $P6_5$} of pattern data P6.

Dot $P6_1$ in pattern data P6 is non-print-dot data. As a result, the arithmetic unit 3 confirms no need for supplying power for generating heating energy to the heating resistor corresponding to dot $P6_1$. The arithmetic unit 3 sets the number of pulses, which are supplied, at "zero".

Next, dot $P6_2$ in pattern data P6 is print-dot data. AND operation by the arithmetic unit 3 confirms that adjacent dot $P5_2$, which is printed just before $P6_2$, is print-dot data. Similarly, it is confirmed that adjacent dot $P6_1$, which is simultaneously printed, is non-print-dot data.

Likewise, it is confirmed that adjacent dot $P6_3$, which is simultaneously printed, is non-print-dot data. As a result, the arithmetic unit 3 sets the number of pulses, which are supplied to the heating resistor corresponding to dot $P6_2$, at "four", as shown in FIG. 6B.

Dot $P6_3$ in pattern data P6 is non-print-dot data. As result, the arithmetic unit 3 confirms no need for supplying power for generating heating energy to the heating resistor corresponding to dot $P6_3$. The arithmetic unit 3 sets the number of pulses, which are supplied, at "zeros".

Dot $P6_4$ in pattern data P6 is pattern data. AND operation by the arithmetic unit 3 confirms that adjacent dot $P5_4$, which is printed just before $P6_4$, is print-dot data. Similarly, it is confirmed that adjacent dot $P6_3$, which is simultaneously printed, is non-print-dot data.

Likewise, it is confirmed that adjacent dot $P6_5$, which is simultaneously printed, is non-print-dot data. As a result, the arithmetic unit 3 sets the number of pulses, which are supplied to the heating resistor corresponding to dot $P6_4$, at "four", as shown in FIG. 6C.

Next, dot $P6_5$ in pattern data P6 is non-print-dot data. As a result, the arithmetic unit 3 confirms no need for supplying power for generating heating energy to the heating resistor corresponding to dot $P6_5$. The arithmetic unit 3 sets the number of pulses, which are supplied, at "zero".

After the thermal head 5, controlled by the controller 4, finishes printing pattern data P4, the CPU 1 reads pattern data P5 and control data on the dots of pattern data P5 from the arithmetic unit 3, and outputs them to the controller 4. The outputs cause the controller 4 to use the thermal head 5 to start printing pattern data P5.

At the same time, the CPU 1 reads pattern data P7 from the storage unit 2, and writes them in the shift register in the arithmetic unit 3. The writing causes the arithmetic unit 3 to perform print processing based on adjacent data on each dot, as to the dots of pattern data P6 and the dots of pattern data P7 stored in the shift register.

After the thermal head 5, controlled by the controller 4, finishes printing pattern data P5, the CPU 1 reads pattern data P6 and control data on the dots of pattern data P6 from the arithmetic unit 3, and outputs them to the controller 4. The outputs cause the controller 4 to use the thermal head 5 to start printing pattern data P6. Print face R1, formed at this time by the heating resistor corresponding to dot $P6_3$, can be fine printed to form fine pattern data.

As described above, the arithmetic unit 3 easily detects whether dots adjacent to each dot in pattern data are print-dot data or non-print-dot data. Accordingly, the CPU 1 can obtain conditions used for each dot to generate predetermined heating energy, using temperature data on the thermal head 5 based on the density of print dots adjacent to each dot in pattern data and detection signal from measuring means.

Therefore, according to a thermal head controller according to one embodiment of the present invention, on a polyethylene foam sheet, the concentration and size of dots, formed so as to correspond to the print-dot data of pattern data, can advantageously be controlled to be uniform. As a result, the thermal head controller has no bubble clogging beyond a necessary range for a stamp print face, and can form a stamp print face on which fine lines are not erased.

Next, a third embodiment of the present invention will be described with reference to FIG. 8.

Figure 8:
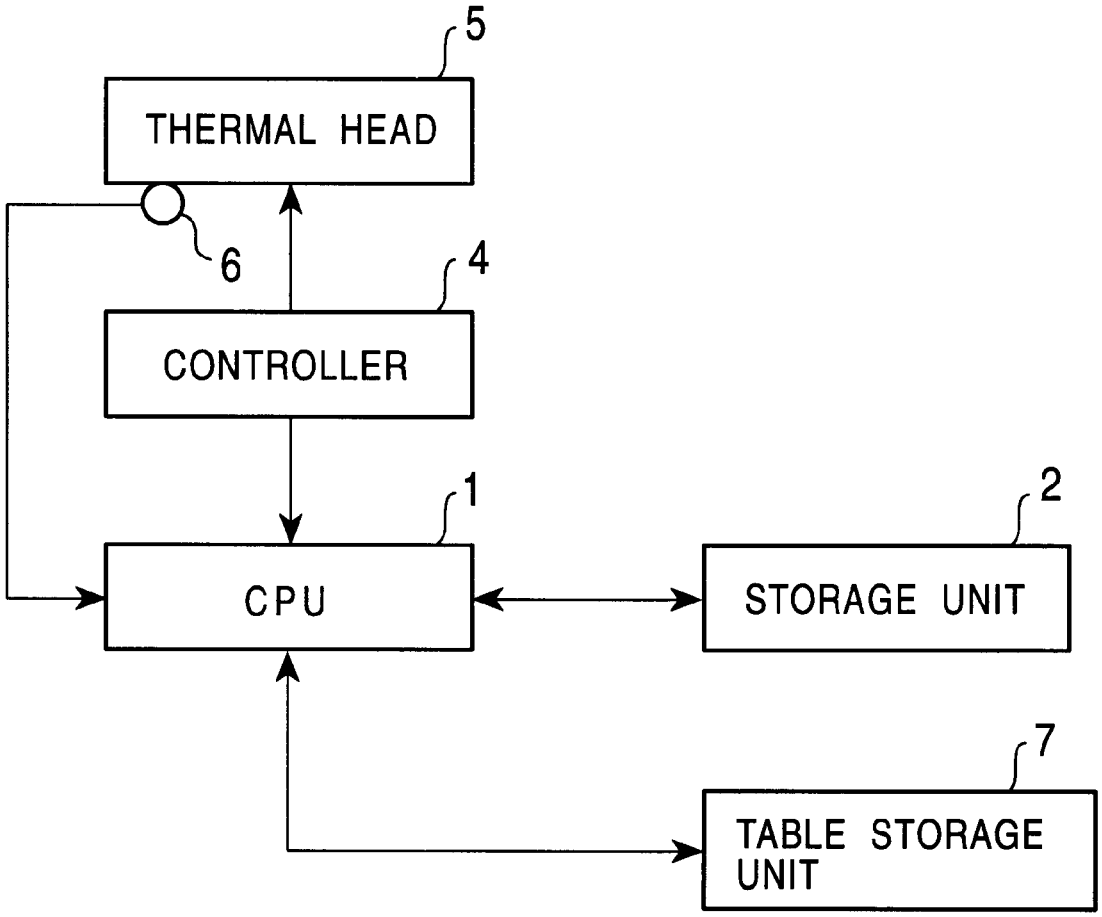
FIG. 8 is a block diagram showing a thermal head controller according to a third embodiment of the present invention.
Figure 9A:
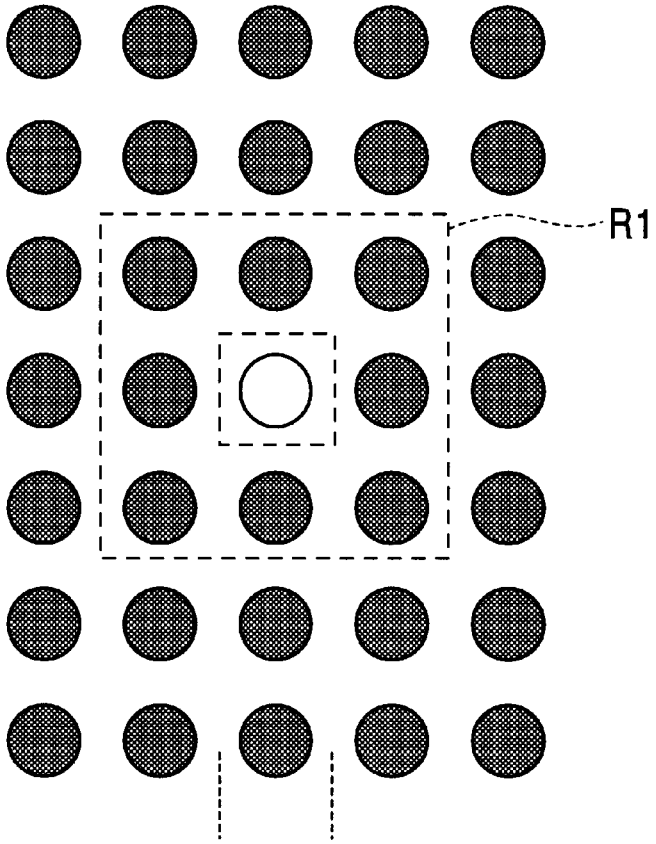
FIG. 9A PRIOR ART
FIGS. 9A, 9B are pattern views showing a print face formed by a conventional thermal head controller.
Figure 9B:
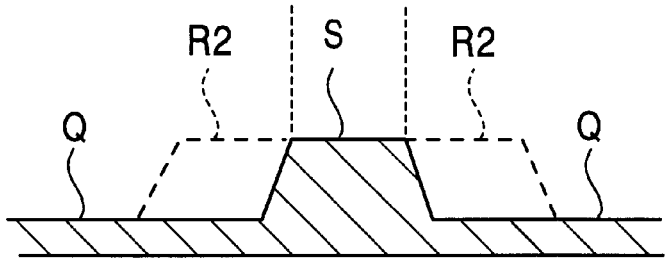
FIG. 9B PRIOR ART

As shown in FIG. 8, a thermal head controller according to the third embodiment includes a table storage unit 7 in place of the arithmetic unit 3 in the thermal head controller (shown in FIG. 4) according to the second embodiment. The table storage unit 7 includes a read only memory, and holds control data to be supplied to heating resistors for causing the heating resistors to generate predetermined heating energy.

When the table storage unit 7 is supplied with temperature data on a thermal head 5 which is measured by a temperature sensor 6, supplied from a CPU 1, pattern data to be processed for printing and other pattern data to be printed just before the pattern data, the table storage unit 7 selects and outputs predetermined control data on the corresponding dot from its data table.

This causes the CPU 1 to time-serially output pattern data processed for printing to a controller 4, and the controller 4 uses the thermal head 5 to print the sequentially supplied pattern data, based on control data for each dot.

The CPU 1 reads the next data from a storage unit 2, and causes the table storage unit 7 to perform the above-described printing.

As described above, the table storage unit 7 easily detects whether dots adjacent to each dot in pattern data are either print-dot data or non-print-dot data. As a result, the CPU 1 uses the density of print-dot data among dots adjacent to each dot in the pattern data, and temperature data on the thermal head 5 based on a detection signal from a measuring means, whereby the CPU 1 can obtain conditions for causing each dot to generate heating energy from a data table stored in the ROM.

Therefore, the thermal head controller according to the third embodiment also provides an advantage in which, on a polyethylene foam sheet, the concentration and size of dots formed such that print-dot data in pattern data are printed can be made uniform. Accordingly, a thermal head controller according to one embodiment of the present invention has no bubble clogging beyond a necessary range for a stamp print face, and can form a stamp print face on which fine lines are not erased.

What is claimed is:

1. A thermal head controller for controlling heating energy generated from heating resistors provided in a thermal head by using pattern data composed of dot data as print-dot data representing print dots and non-print-dot data representing non-print dots so that the thermal head performs predetermined printing, said thermal head controller comprising:

storage means for holding said pattern data;

comparing means for comparing dot data in said pattern data and other data adjacent to the dot data, and outputting the compared result;

data conversion means for converting said print-dot data, which are obtained when the compared result shows that print dots and non-print dots are adjacently positioned, into adjacent-dot data representing that the print dots are adjacent to said non-print dots; and energy control means for controlling the heating energy generated from the heating resistors in the thermal head by using said print-dot data, said non-print-dot data and said adjacent-dot data;

wherein said print-dot data and said non-print-dot data contain a plurality of data bits; and wherein said comparing means detects whether or not the print dots and the non-print dots are adjacent to each other by performing a logical AND calculation between lowest bits of the adjacent dot data.

2. A thermal head controller according to claim 1, wherein said heating resistors in said thermal head are supplied with a number of predetermined voltage pulses controlled by said energy control means whereby heat-generating energy of the heating resistors is controlled by said energy control means.

3. A thermal head controller for controlling heating energy generated from heating resistors provided in a thermal head by using pattern data composed of a plurality of dot data as print-dot data representing print dots and non-print-dot data representing non-print dots so that the thermal head performs predetermined printing, said thermal head controller comprising:

first storage means for holding said pattern data;

measuring means for measuring the temperature of said thermal head and outputting resultant temperature data;

detection means for detecting whether adjacent dot data in said pattern data are either print-dot data or non-print-dot data and outputting a resultant detection signal;

arithmetic means for computing a power value to be supplied to the heating resistors, based on at least said temperature data and said detection signal; and energy control means for controlling heating energy generated from the heating resistors, based on said power value;

wherein said print-dot data and said non-print-dot data contain a plurality of data bits; and wherein said detection means detects whether or not the print dots and the non-print dots are adjacent to each other by performing a logical AND calculation between lowest bits of the adjacent dot data.

4. A thermal head controller according to claim 3, wherein said heating resistors in said thermal head are supplied with a number of predetermined voltage pulses controlled by said energy control means whereby heat-generating energy of the heating resistors is controlled by said energy control means.

5. A thermal head controller for controlling heating energy generated from heating resistors provided in a thermal head by using pattern data composed of dot data as print-dot data representing print dots and non-print-dot data representing non-print dots so that the thermal head performs predetermined printing, said thermal head controller comprising:

first storage means for measuring the temperature of said thermal head, and outputting temperature data as a result;

detection means for detecting whether adjacent dot data in said pattern data are either print-dot data or non-print-dot data and outputting a resultant detection signal;

second storage means for holding a power value corresponding to at least said temperature data and said detection signal;

reading means for reading from said second storage means said power value, based on said temperature data and said detection signal; and energy control means for controlling heating energy from the heating resistors, based on the read power value;

second storage means holding, in a table form, a power value supplied to the heating resistors of print dots.

6. A thermal head controller according to claim 5, wherein said reading means performs a logical AND operation of two adjacent dot data wherein said print-dot data and said non-print-dot data contain a plurality of data bits and wherein said detecting means detects whether or not the print dots and the non-print dots are adjacent to each other by performing said logical AND calculation between lowest bits of the adjacent dot data.

7. A thermal head controller according to claim 5, wherein said heating resistors in said thermal head are supplied with a number of predetermined voltage pulses controlled by said energy control means whereby heat-generating energy of the heating resistors is controlled by said energy control means.

* * * * *